US005241724A

United States Patent [19]

Lim

[11] Patent Number: 5,241,724

[45] Date of Patent: Sep. 7, 1993

[54] VACUUM CLEANER HAVING THE FUNCTION OF WET WIPING RAG

[75] Inventor: Won-Kyu Lim, Seoul, Rep. of Korea

[73] Assignee: Samsung Electronics Co., Ltd., Suweon, Rep. of Korea

[21] Appl. No.: 804,043

[22] Filed: Dec. 9, 1991

[30] Foreign Application Priority Data

Dec. 14, 1990 [KR] Rep. of Korea ..... 90-19875

[51] Int. Cl.[5] ..... A47L 11/14

[52] U.S. Cl. ..... 15/322; 15/52; 15/321; 15/388

[58] Field of Search ..... 15/320, 321, 322, 388, 15/51, 52

[56] References Cited

U.S. PATENT DOCUMENTS

| | | | |
|---|---|---|---|
| 1,066,201 | 7/1913 | Fulper | 15/322 |
| 1,176,990 | 3/1916 | Scherff | 15/320 |
| 1,296,868 | 3/1919 | Smith | 15/320 X |
| 1,506,016 | 8/1924 | Lundgren | 15/52 |
| 4,369,544 | 1/1983 | Parisi | 15/320 |
| 4,433,451 | 2/1984 | Parisi | 15/322 X |
| 4,845,794 | 7/1989 | Korski et al. | 15/320 X |

*Primary Examiner*—Chris K. Moore

*Attorney, Agent, or Firm*—Burns, Doane, Swecker & Mathis

[57] ABSTRACT

A vacuum cleaner includes a housing having a suction opening disposed between front and rear brushes for sucking dirt from a floor. A rag disposed behind the rear brush is rotatably driven about a transverse axis by the reciprocal action of the housing as the latter is displaced along the floor. A water supply keeps the rag moist. The rag is driven such that the floor-engaging portion is driven in a direction opposite the direction of housing travel. An auxiliary opening in the suction line sucks dirt from the rag at a location above the floor.

12 Claims, 5 Drawing Sheets

VACUUM CLEANER HAVING THE FUNCTION OF WET WIPING RAG

FIELD OF THE INVENTION

The present invention relates to a vacuum cleaner.

BACKGROUND OF THE INVENTION

The conventional vacuum cleaner has a simple function of sucking the dust adhered on a floor or carpet by utilizing the strong sucking power of a sucking motor. However, for some articles such as carpet which is impossible to wash at home, the conventional vacuum cleaner can not perform an effective cleaning.

In an attempt to give a solution to the above described problem, a vacuum cleaner (as shown in FIG. 4) has previously been developed, and this vacuum cleaner is constituted such that: a water reservoir C is disposed between a dust collecting section A and a driving section B; an extended tube E is connected to the leading end of a hose D (connected to the dust collecting section A); and a plurality of head sections F such as a dust sucking port, a water sucking port and the like are provided on the leading end of the extended tube E, thereby making it possible to use them selectively depending on the requirement.

Meanwhile, Japanese Utility Model Publication No. Sho-57-189546 proposes a shampoo type cleaner, as shown in FIG. 5, constituted such that: a cleaning brush G and a water blocking brush G' are installed at the lower end of a head section F; a washing water supplying tube H and a detergent supplying tube H' are formed on the top of the cleaning brush G in order to supply water and detergent; and a sucking mouth I is formed along the sides of the tubes H,H'.

However, the above described cleaning apparatuses have disadvantages such that the user has to take the trouble of replacing the head sections, and that the water drops remaining on the floor have to be removed by the user after the completion of the cleaning.

SUMMARY OF THE INVENTION

The present invention is intended to overcome the above described disadvantages of the conventional techniques.

Therefore it is the object of the present invention to provide a vacuum cleaner having the function of a wet wiring rag in which wet cleaning and the supply of washing fluid is possible and in which dirt and dirty water as well as dust and floating materials can be sucked up.

In achieving the above object, the vacuum cleaner of the present invention having the function of a wet wiping rag and including a dust collecting section, a driving section and a water reservoir, further includes: a head body having a tube inserting portion connected to the dust collecting section, and also having a washing water connecting portion extended from a side of the head body to enable the supply of water from the water reservoir to be possible; a rag detachably clad on the circumference of a roller freely rotatably installed in such a manner as to extend between the opposite sides of the head body; wheels having respectively a floor contact portion and closely contacted to gears provided to the opposite ends of the roller; a cover having dirty water collecting holes near the rags, and also having a washing water reservoir fixedly installed on the bottom of the head body and with a discharge hole formed below the washing water connecting portion; a frontal brush and blade installed respectively on the bottom of the frontal and rear portion of the head body; and a rear brush installed on the bottom of the cover.

Further, the frontal brush is provided with a plurality of slots on the bottom thereof.

Further, the rear brush is formed in an arcuate shape.

BRIEF DESCRIPTION OF THE DRAWINGS

The above object and other advantages of the present invention will become more apparent by describing in detail the preferred embodiment of the present invention with reference to the attached drawings in which:

FIG. 2 illustrates the brush portion of the present invention in which.

DESCRIPTION OF THE PREFERRED EMBODIMENT

Figure 1:
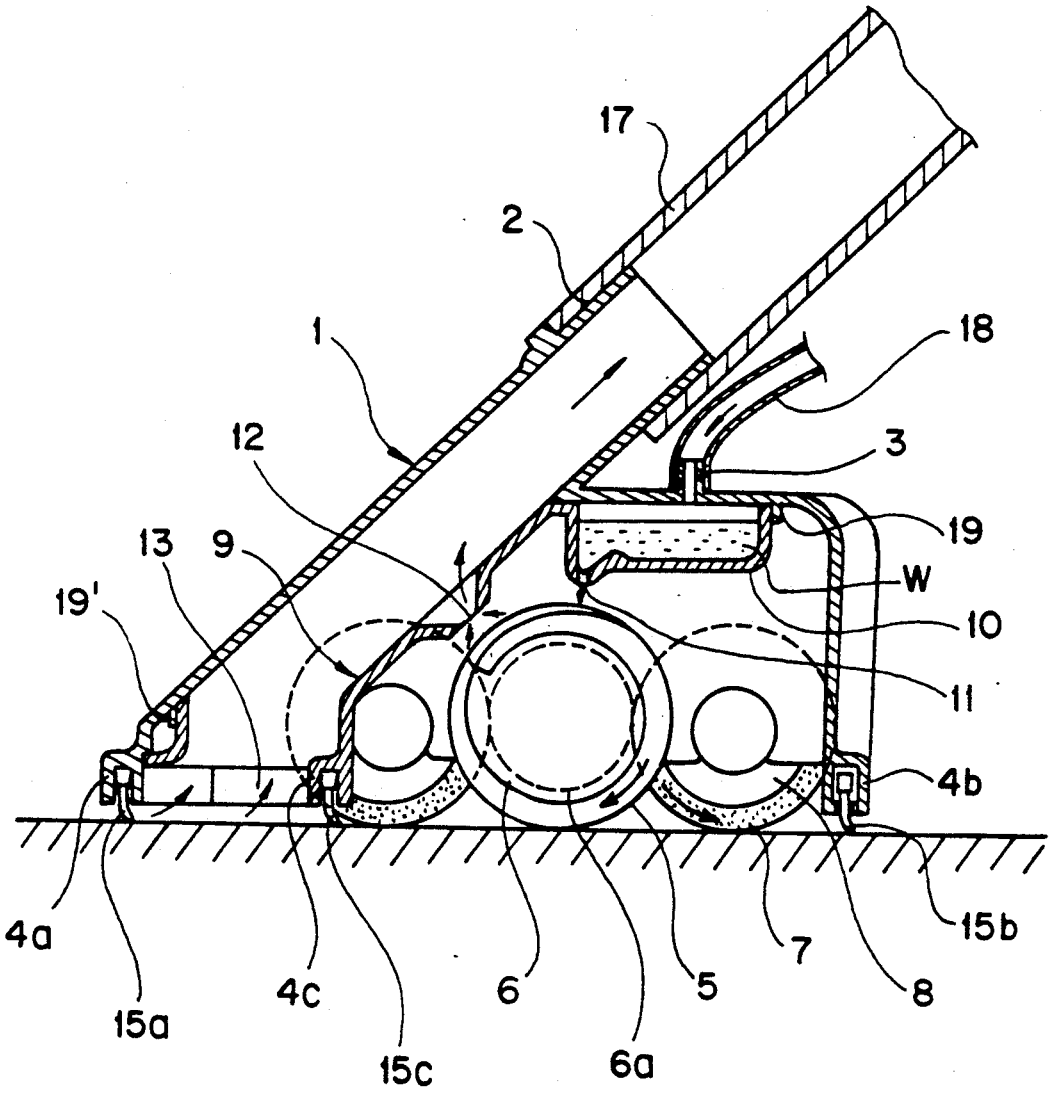
FIG. 1 is a side sectional view showing the critical portion of the vacuum cleaner having the function of a wet wiping rag according to the present invention.

FIG. 1 is a side sectional view of the critical portion of the vacuum cleaner having the function of a wet wiping rag according to the present invention. In the drawing, reference numeral 1 indicates a head body, and this head body 1 includes: a tube inserting portion 2 extended from the top toward the rear in an inclined form; a washing water connecting portion 3 for supplying the washing water and projected from a side thereof; a brush securing slot 4*a* and a blade securing slot 4*b* provided on the bottoms of the frontal and rear portions thereof; and an opening formed on the bottom thereof.

A roller 6 is installed in such a manner that it should extend between the opposite sides of the head body 1, and the roller 6 is attached with a rag 5 in a detachable manner, while gears 6*a* are formed on the opposite ends of the roller 6. At the opposite sides of each of the gears 6*a*, there are installed wheels 8 on which contacting portions 7 (made of a soft material in order to prevent slipping) are attached and which are closely contacted with the gears 6*a* to be revolved together. The rag 5 is made of a non-woven fibre and is detachable.

A cover 9 is installed by being inserted in the bottom of the head body, and this cover 9 is provided with a washing water reservoir 10 at a position opposite to that of the washing water connecting portion 3, while a supply hole 11 is formed on the bottom thereof in order to supply washing water W to the rag 5. Further, an auxiliary dirty water collecting hole 12 is formed in the cover 9 near the rag 5 in order to suck up the dirty water from the rag 5, and brush securing slots 4*a*,4*c* are formed on the bottom of the head body and the cover 9, respectively. The cover 9 and body 1 together form a housing.

The cover 9 which is installed on the bottom of the head body 1 includes a dust sucking hole 13 through which dusts and dirty materials are sucked in.

A frontal brush 15*a* and a rear brush 15*c* are fixedly installed into the brush securing slots 4*a*,4*c*, respectively.

Figure 2A:
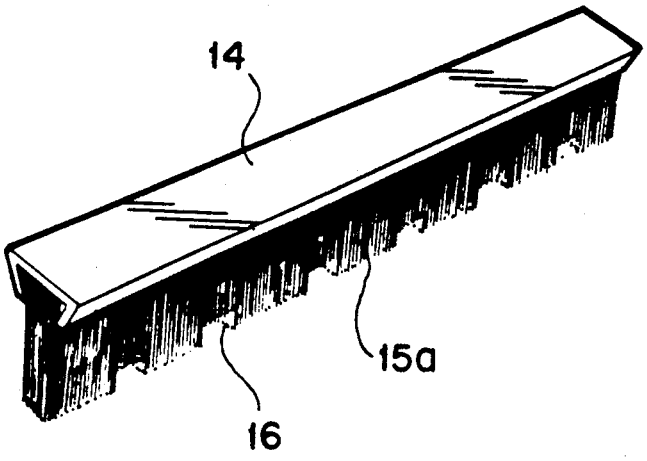
FIG. 2*a* is a perspective view of the frontal brush.

As shown in FIG. 2*a*, the frontal brush 15*a* is provided with a plurality of slots on the bottom thereof in order to facilitate the absorption of dusts and other dirty materials.

Figure 2B:
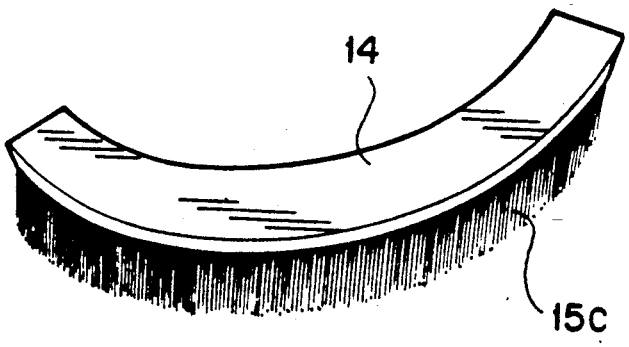
FIG. 2*b* is a perspective view of the rear brush.

As shown in FIG. 2*b*, the rear brush 15*c* is formed in an arcuate shape, so that it should be easy to collect dusts and other dirty materials.

A blade 15*b* is securely fitted into the blade securing slot 4*b*, in such a manner that the blade should be able to collect water from the rear portion of the rag 5, so that the water should be re-absorbed during a reverse advancement.

In the drawings, reference numeral 17 indicates a handle in the form of an extended tube connected to the outside of the tube inserting portion 2 and connected to the dust collecting section, 18 indicates a washing water tube fitted into the washing water connecting portion 3 in order to supply water from the washing water reservoir, 19,19' indicate securing protuberanes for installing the cover 9.

The vacuum cleaner having the function of a wet wiping rag according to the present invention as described above can be let to perform cleaning operations by positioning the head body 1 to a place to be cleaned, and by advancing it back and forth, with the extended tube 17 grasped with hands.

Figure 3:
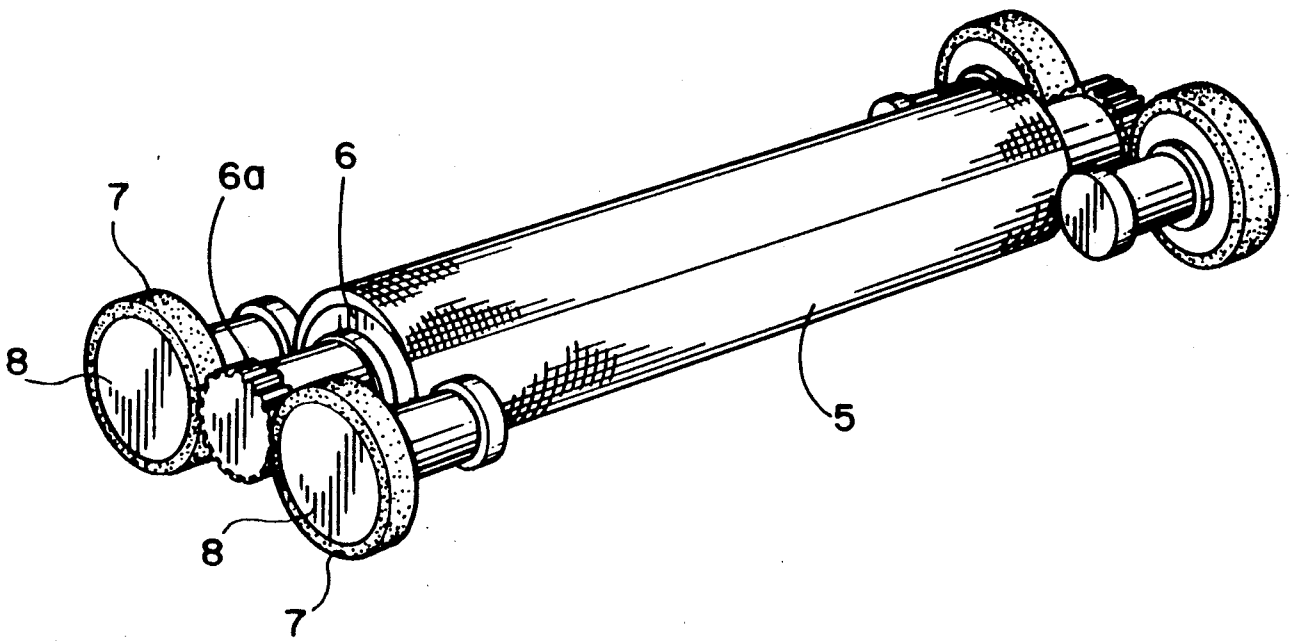
FIG. 3 is a perspective view showing the operational relation between the roller and the wheels.
Figure 4:
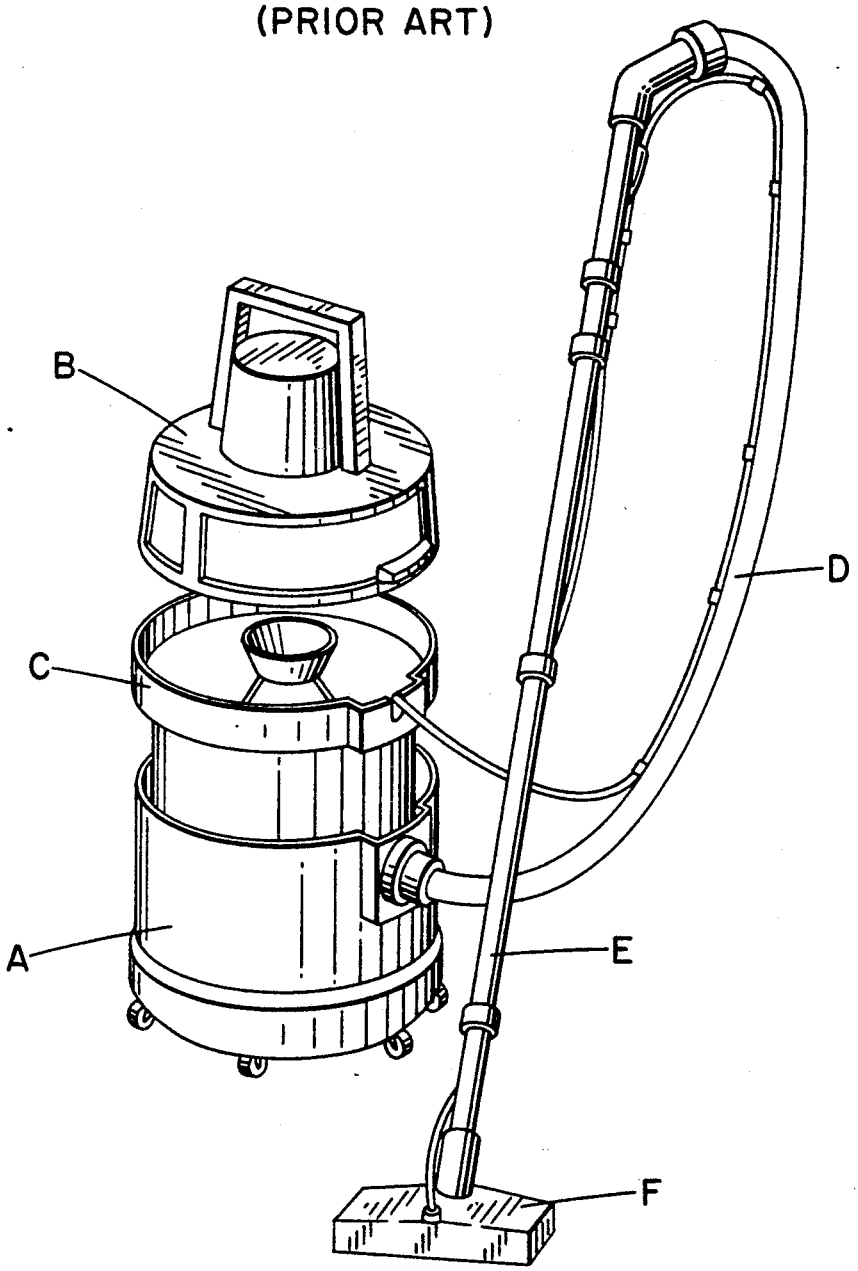
FIG. 4 (PRIOR ART)
FIG. 4 is a perspective view of the whole body of a conventional vacuum cleaner.
Figure 5:
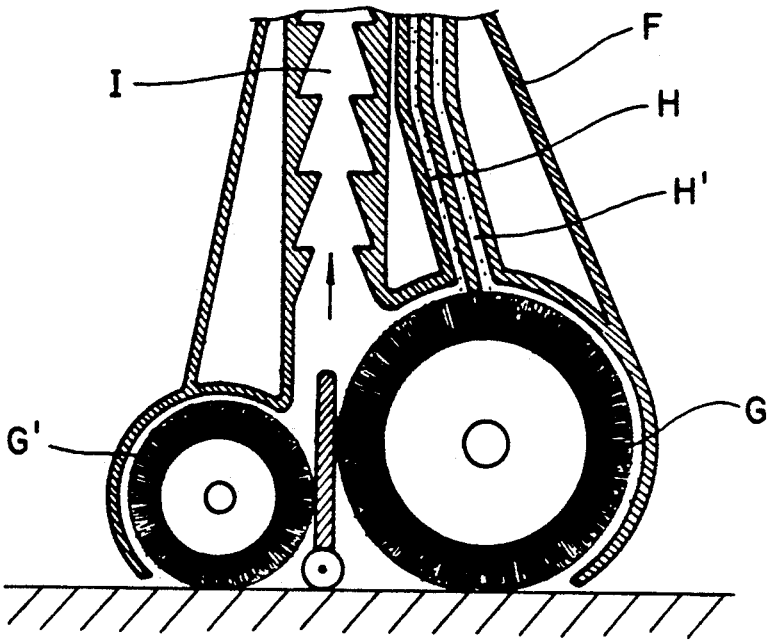
FIG. 5 (PRIOR ART)
FIG. 5 is a side sectional view showing the head portion of another conventional vacuum cleaner.

Under this condition, if a sucking force is caused to act on the sucking hole 13 by the function of the driven motor, the dusts and other dirty materials which are detached from the floor by the frontal and rear brushes are sucked into the sucking hole 13. At the same time, the gears 6*a* which are closely contacted with the floor contacting portions 7 are revolved in accordance with the revolutions of the wheels 8, and therefore, the rag 5 which is attached on the roller 6 as shown in FIG. 3 cleans the floor like a wet wiping rag in a frictional relation with the floor.

Under this condition, the washing water which is filled through the washing water tube 18 into the washing water reservoir 10 is supplied through the discharge hole 11 to the circumferential surface of the roller 6 in a certain amount, so that the floor should be cleaned like with a wet rag. Thus, when the wheels 8 are revolved forwardly or rearwardly, the frontal brush 15*a* collects dusts and other dirty materials from the frontal area to send them through the slots 16 (formed on the bottom thereof) to the dust sucking hole 13. Meanwhile, the rear brush 15*c* which is formed in an arcuate shape further facilitates the collection of the dust and other dirty materials to send them to the sucking hole 13. Meanwhile, the blade 15*b* scrapes the dusts and other dirty materials which are not detached by the brushes, so that the detached dusts and other dirty materials as well as dirty water should be absorbed into the rag 5 during the rearward advancement, thereby making it possible to remove all the water remaining on the floor.

Meanwhile, the dirty materials and dirty water which are absorbed into the rag 5 are collected into the dirty water collecting hole 12 which is formed on the cover 9, and therefore, the rag 5 can be maintained always in a clean state, thereby making the cleaning more efficient.

The roller 6 revolves in a direction opposite to that of the wheels 8 because of the existence of the gears 6*a*, and therefore, during a forward advancement, the friction between the rag 5 and the floor is further increased, thereby increasing the cleaning efficiency further.

According to the vacuum cleaner of the present invention having the function of a wet wiping rag, dusts and other dirty materials are sucked into a sucking hole, and at the same time, a revolving rag produces frictions with the floor in order to absorb dirty materials and dirty water, with the result that the cleaning work becomes easy and convenient, that the cleaning time is shortened, and that a thorough cleaning becomes possible by sucking the dusts and other dirty materials detached from the floor by the blade.

What is claimed is:

1. A vacuum cleaner comprising:

a manually displaceable housing disposed at an end of a handle, said handle forming a suction line which forms in said housing a lower suction opening for sucking dirt from a floor as said housing is displaced forwardly and rearwardly along the floor, front and rear brushes extending along front and rear sides of said suction opening, respectively, said rear brush deflecting dirt toward said suction opening as said housing is displaced forwardly, and said front brush deflecting dirt toward said suction opening as said housing is displaced rearwardly, a dustcloth mounted to said housing adjacent said rear brush such that a lower portion of said dustcloth contacts the floor as said housing is displaced therealong, liquid supplying means for supplying liquid to said dustcloth for keeping said dustcloth moist, and dustcloth displacing means for displacing said dustcloth relative to said housing such that said lower portion thereof moves in a direction opposite the direction of housing displacement, so that said lower portion of said dustcloth is raised from the floor to a position where dirt collected on said dustcloth can be removed by suction through an auxiliary suction opening in said suction line.

2. A vacuum cleaner according to claim 1, wherein said dustcloth, displacing means is arranged to rotate said dustcloth about a transverse axis extending transversely relative to the front-to-rear direction.

3. A vacuum cleaner according to claim 2, wherein said dustcloth displacing means includes at least one wheel positioned to contact the floor and to be driven in response to such contact when said housing is displaced along the floor.

4. A vacuum cleaner according to claim 3, wherein said dustcloth displacing means includes a cylinder mounted for rotation about an axis extending transversely relative to the front-to-rear direction, wherein said dustcloth is mounted on an outer periphery of said cylinder.

5. A vacuum cleaner according to claim 1, wherein said dustcloth is disposed behind said rear means.

6. A vacuum cleaner according to claim 1, wherein said liquid supplying means comprises a liquid reservoir disposed above said dustcloth.

7. A vacuum cleaner according to claim 1, wherein said dustcloth is annular and mounted concentrically on an outer periphery of a cylinder.

8. A vacuum cleaner comprising:

a manually displaceable housing disposed at an end of a handle, said handle forming a suction line which forms in said housing a downwardly lower suction opening for sucking dirt from a floor as said housing is displaced forwardly and rearwardly along the floor, front and rear dirt-deflecting brushes extending along front and rear sides of said suction opening, respectively, said rear brush deflecting dirt toward said suction opening as said housing is displaced forwardly, and said front brush deflecting dirt toward said suction opening as said housing is displaced rearwardly, a cylindrical dustcloth mounted behind said rear brush and arranged for rotation about an axis extending transversely to the front-to-rear direction, said dustcloth arranged such that a lower portion thereof contacts the floor, dustcloth-driving means engageable with the floor and operably connected to said dustcloth for rotating said dustcloth about said axis in response to displacement of said housing, such that said lower portion of said dustcloth moves opposite the direction of housing displacement, liquid supplying means for supplying liquid to said dustcloth to keep said dustcloth moist, and a resilient blade disposed behind said for contacting the floor to wipe moisture forwardly during forward movement of said housing, said suction line including an auxiliary inlet arranged to suck dirt from said dustcloth at a location disposed above the floor.

9. A vacuum cleaner according to claim 1, wherein said front brush includes spaced-apart slots along its lower edge.

10. A vacuum cleaner according to claim 9, wherein said rear brush is arcuate as viewed in plan, a concave side of said rear brush facing forwardly.

11. A vacuum cleaner according to claim 11, wherein said rear brush is arcuate as viewed in plan, a concave side of said rear brush facing forwardly.

12. A vacuum cleaner according to claim 8, wherein said front brush includes spaced-apart slots along its lower edge.

* * * * *